US008899835B2

(12) United States Patent
Russell

(10) Patent No.: US 8,899,835 B2
(45) Date of Patent: Dec. 2, 2014

(54) SELF-SUPPORTING BLADDER SYSTEM FOR A DOUBLE WALL TANK

(76) Inventor: David D. Russell, Blodgett, MO (US)

( * ) Notice: Subject to any disclaimer, the term of this patent is extended or adjusted under 35 U.S.C. 154(b) by 502 days.

(21) Appl. No.: 13/161,346

(22) Filed: Jun. 15, 2011

(65) Prior Publication Data

US 2011/0305409 A1 Dec. 15, 2011

Related U.S. Application Data

(60) Provisional application No. 61/354,757, filed on Jun. 15, 2010, provisional application No. 61/363,958, filed on Jul. 13, 2010.

(51) Int. Cl.

| | |
|---|---|
| ***B65D 33/02*** | (2006.01) |
| ***B65D 30/08*** | (2006.01) |
| ***B65D 30/10*** | (2006.01) |
| ***B65D 90/04*** | (2006.01) |
| *B65D 90/50* | (2006.01) |

(52) U.S. Cl.

CPC ..... *B65D 90/046* (2013.01); *B65D 90/501* (2013.01); *B65D 2590/046* (2013.01)

USPC ..... 383/119; 383/111; 220/9.1

(58) Field of Classification Search

CPC ..... B65D 90/501; Y10S 220/901; Y10S 220/918

USPC ..... 383/119, 3, 105, 109, 111; 220/9.1, 9.2, 220/9.3, 9.4; 428/230.2, 213

See application file for complete search history.

(56) References Cited

U.S. PATENT DOCUMENTS

| | | | | |
|---|---|---|---|---|
| 3,044,515 | A * | 7/1962 | Eades | 383/3 |
| 4,552,166 | A * | 11/1985 | Chadbourne, Sr. et al. | 137/15.04 |
| 4,901,676 | A * | 2/1990 | Nelson | 122/19.2 |
| 4,925,057 | A * | 5/1990 | Childress et al. | 244/135 R |
| 5,022,555 | A * | 6/1991 | Greenbaum | 210/201 |
| 5,065,890 | A * | 11/1991 | Greenbaum | 137/585 |
| 5,199,609 | A * | 4/1993 | Ash, Jr. | 222/94 |
| 5,351,847 | A * | 10/1994 | Greenbaum | 220/9.1 |
| 5,874,151 | A * | 2/1999 | Cohee et al. | 428/102 |
| 5,904,265 | A * | 5/1999 | Zandbergen et al. | 220/62.19 |
| 6,000,604 | A * | 12/1999 | Lapoint, III | 229/117.35 |
| 6,113,270 | A * | 9/2000 | Hafer | 383/119 |
| 6,287,003 | B1 * | 9/2001 | Hafer | 383/119 |
| 6,550,628 | B1 * | 4/2003 | Sedlmayr | 220/9.1 |
| 7,303,091 | B2 | 12/2007 | Lombari | |
| 7,621,422 | B2 * | 11/2009 | Reed et al. | 220/571 |

(Continued)

FOREIGN PATENT DOCUMENTS

| | | | | |
|---|---|---|---|---|
| EP | 269586 | A2 * | 6/1988 | B65D 90/04 |
| JP | 3538805 | B2 | 4/2004 | |

OTHER PUBLICATIONS

International Search Report, International Patent Application No. PCT/US2011/040557, mailed Jan. 18, 2012, 3 pages.

*Primary Examiner* — Jes F Pascua

(74) *Attorney, Agent, or Firm* — Haugen Law Firm PLLP

(57) ABSTRACT

A self-supporting bladder that can be installed into existing storage tanks, particularly into underground storage tanks and a method of forming a double walled tank using the same. This self-supporting bladder serves as the inner wall, utilizing the existing tank as the outer wall of a double wall system, or can provide a double wall system such as through the use of an insert placed in the bladder.

15 Claims, 9 Drawing Sheets

(56) References Cited

U.S. PATENT DOCUMENTS

| | | | | |
|---|---|---|---|---|
| 7,938,283 | B2 * | 5/2011 | Villers et al. | 220/1.5 |
| 7,946,764 | B2 * | 5/2011 | Sulpizio et al. | 383/33 |
| 8,408,417 | B2 * | 4/2013 | Crone et al. | 220/565 |
| 2006/0131314 | A1 | 6/2006 | Lombari et al. | |
| 2007/0045327 | A1 | 3/2007 | Beall | |
| 2008/0271811 | A1 | 11/2008 | Healy | |
| 2009/0196531 | A1 * | 8/2009 | Liao et al. | 383/3 |
| 2009/0279812 | A1 * | 11/2009 | Blanchard | 383/119 |

* cited by examiner

SELF-SUPPORTING BLADDER SYSTEM FOR A DOUBLE WALL TANK

CROSS REFERENCE TO RELATED APPLICATION(S)

This application claims benefit of and priority to U.S. Provisional Patent application Ser. No. 61/354,757 filed Jun. 15, 2010 and U.S. Provisional Patent Application Ser. No. 61/363,958 filed Jul. 13, 2010. The entire disclosure of both the above documents is herein incorporated by reference.

BACKGROUND

1. Field of the Invention

This invention relates to a self-supporting bladder such as can be used to retrofit an existing single wall storage tank into a double wall storage tank 2. Description of Related Art Commercial and industrial liquids of all types are stored in storage tanks. One of the most notable such types of storage is for motor vehicle fuel. For reasons of space, many of these tanks are placed underground to be able to supply filling stations and other places where large amounts of liquids are to be stored and distributed. Underground fuel tanks are generally cylindrical in shape and usually have a capacity in the range of 500 to 20,000 gallons or more. Such tanks are generally made of either metal (usually steel) or a fiber reinforced resinous material to resist the often corrosive nature of the materials stored in them.

Storage tanks also are used in a variety of other situations for the storage of liquids. Tanks can be used in industrial settings for the storage of liquids to be used in manufacturing, can be used as storage for end products prior to shipping, or can be used as part of a manufacturing process. Storage tanks are quite ubiquitous and can store all manner of liquids. They are commonly used for the storage of fuels, water, foods, and valuable chemicals, but also can be used to store waste or raw materials. While most of these tanks are in a generally standard size range, they can range from small sizes of less than 100 gallons, to massive tanks the size of small buildings.

Because the liquids stored in such tanks are often hazardous (gasoline for use as a motor fuel being one of the most common), and thus can cause severe environmental damage and greatly impact the lives of people living, working, and recreating in nearby areas, careful attention to the potential for leaks from such tanks must be exercised. In some cases, even small leakage from such an underground tank can have profound effects as the chemical can serve to poison a local water supply, or lead to a situation where nearby soil or other materials become directly hazardous to life. The fact that many of these storage tanks are in areas of higher population density simply exaggerates the problems.

Due to these potential problems from leaks, safer storage tanks have been designed with a double wall, such that a breach in the integrity of either of the inner or outer wall alone will not allow a leak of the liquid contained in the tank outside of the tank. The use of such double-walled tanks (or equivalents thereof, wherein some sort of secondary containment is provided for an otherwise single-walled tank) is increasingly being mandated by government regulation, particularly when such tanks are placed underground or in places where a leak could potentially contaminate soil, air, or water.

While new tanks can be built to more stringent safety standards, because a large number of tanks have already been placed prior to the rules being imposed and the operation for removing and replacing them can be economically unviable, it is often the case that tanks need to be retrofitted in place to comply with more stringent safety regulations or simply taken out of service, which results in a major waste of resources. In one alternative, a tank structure that provides added safety from the hazards of leaking storage tanks comprises the retrofit of a liner which is installed in a single wall tank that has been in use and is already in the ground or in position for use. Certain of these liners can be installed without removing the tank from its original position. Such a lining can be significantly more economical to install as compared with removal and replacement of the single-walled tank with a new double-walled tank.

In one arrangement, a rigid tank liner is used to line the existing tank with a second (and, in some cases, third) wall. A method of retrofitting tanks has been described in U.S. Pat. No. 5,904,265, the disclosure of which is entirely incorporated herein by reference. This type of method includes providing a double-layered liner comprising a multi-layered fabric having an interstitial space between two generally parallel layers of fabric, the layers being supported at a distance from one another by generally perpendicular fabric pylons, all of which is reinforced and hardened by a resin polymerization.

Resin tank liners generally require the existing tank to be completely emptied and then thoroughly cleaned before it can be retrofitted. If the existing tank is not properly cleaned prior to the liner installation, the resin liner would not properly adhere to the existing tank and this will result in the resin liner collapsing under the strain of ordinary operation. This cleaning operation, and the installation of the liner itself, all require entry into the tank by personnel to perform the cleaning and installation operations.

The environment inside a storage tank can be incredibly hazardous. For one, the tank may still include gaseous fumes from the material it was previously filled with which can be toxic and result in asphyxiation or other respiratory problems for personnel. Thus, in such cleaning and related operations, personnel may be required to wear heavy, bulky, and cumbersome protective equipment. Even beyond that, such fumes, for example in a tank which had stored motor fuel, can be highly explosive. This can require the cleaning operation to use specialized tools to try and prevent explosion of the tank during the cleaning and installation activities. It also can require personal safety gear to be redesigned to operate in such an environment to insure that a piece of gear designed to prevent inhalation of fumes, does not serve to ignite them. These issues result in an increased cost in performing the retrofit, as well as often requiring the retrofit to take a longer time, resulting in a longer downtime for the tank.

In order to avoid the problems with a liner, in some situations a flexible bladder is used to allow for installation in situ. In this arrangement, the bladder is placed into the empty tank in a generally collapsed state and is then expanded to fill the internal area inside the tank. The liquid to be placed into the tank is then inserted into the bladder. As the bladder conforms to the internal space of the original outer tank, a double wall tank is created with the bladder as the inner wall and the original outer tank as the outer wall.

One of the advantages of using bladders as opposed to more complex methods is that bladder installation generally does not require entry of personnel into a tank and the internal surfaces of the tank need not be specially prepared for the installation of the bladder. Because the bladder is effectively constructed outside of the tank, it can be inserted into the tank in a collapsed state, and then expanded in place. Further, any small amount of residue will generally not effect safe operation of the resultant double wall tank.

Because the bladder is flexible, it is necessary to hold the bladder in place against the inner surface of the exterior rigid tank in order to give it shape and so as to provide for it to be supported within the tank. Should the bladder be allowed to freely move internal to the tank, the bladder could easily become torn or interfere with operations in the tank as the liquid internal to it forced the bladder to conform to the internal shape of the tank.

In traditional arrangements, the bladder is held in place at certain easily accessible rigid attachment points (such as by attaching it to the tank at an area around an access point), and by then pulling a vacuum between the outer wall of the bladder and the internal wall of the tank. The vacuum serves both to keep the bladder in place in close proximity to the tank wall and to provide a first indication of a leak. Vacuum systems also are desirable because they are relatively simple, and do not require tank entry by personnel to install.

The vacuum system assists in detecting a leak because should the bladder or tank develop a leak, the vacuum will generally not be formed and the failure of the vacuum can be detected. As such failure is indicative that a leak has occurred, the tank requires maintenance to prevent leakage of the fluid therein and such maintenance can be quickly scheduled and the liquid can be removed to a different storage tank before structural failure of the second wall occurs. The problem with the system, however, is that it presumes that the outer tank remains structurally sound in order to maintain structural integrity and when the bladder or outer wall fails, the inability to draw the vacuum may result in further problems.

Because the internal bladder is not structurally self-supporting, should the vacuum fail, the bladder will cease to be held against the inner surface of the existing tank and will instead generally conform to the liquid surface (as the liquid is constrained by the bladder and tank). As the liquid level drops, this can result in the bladder dangling from the rigid attachment at the access point, eventually tearing as the dead weight of the bladder (and the liquid within it) exceeds the attachment point strength, or the strength of the material forming the bladder, and falling into the tank bottom where it can stifle or otherwise interfere with internal pumps. Thus, should a bladder system fail, the tank generally has to be taken completely out of service and the bladder be replaced. Further, the act of getting the tank emptied to perform such service may cause further damage to the bladder and result in further complications for the resultant cleanup.

A further problem with bladder systems is that they are generally reliant on the existing outer tank to form the second wall of the double wall system. Thus, should the outer tank develop a leak, the system no longer will comprise a double wall system and will often have to be taken out of service until the existing tank can be fixed. This is often an expensive and time consuming process, if it is possible at all. Thus, should the existing tank develop a leak, the system may be determined to completely fail and have to be replaced as the system is dependent on the existing tank for support of the bladder and as the second wall of the double walled system.

SUMMARY

Because of these and other problems with the art, described herein, among other things, is a self-supporting bladder that can be installed into existing storage tanks, particularly into underground storage tanks. This self-supporting bladder can serve as the inner wall, utilizing the existing tank as the outer wall of a double wall system, or can provide a double wall system through the use of an insert placed therein so that the existing tank is unnecessary to provide for double wall protection.

The self-supporting bladders herein can be used to retrofit an existing single wall underground storage tank into a double walled (or triple or more walled) storage tank or to add one or more additional walls to a storage tank already having any number of initial walls. There is also described a method of making such a bladder, a tank which utilizes such a bladder, an inner wall insert for use with such a bladder, and the various combinations of insert, bladder, and tank.

There is described herein, among other things, a self supporting bladder for use in retrofitting a tank, the bladder comprising: a bladder wall having an internal volume; and a rib grid attached to the bladder wall; wherein, the bladder wall and the rib grid are both flexible when the bladder is inserted into the tank; and wherein, once positioned in a tank, the rib grid is filled with a fill material which imparts a shape on the bladder wall and makes the bladder self supporting.

In an embodiment of the bladder the fill material is placed in the rib grid in liquid form and hardens to impart the shape on the bladder. This may be because the fill material is self hardening such as, but not limited to, an epoxy resin, or that the fill material hardens when exposed to a catalyst.

In an embodiment of the bladder the fill material comprises a thixotropic gel and/or may be maintained under pressure once placed in the rib grid.

In an embodiment of the bladder the rib grid is attached to an external surface of the bladder wall. In an alternative embodiment, the rib grid is attached to an internal surface of the bladder wall and such bladder may have an inner wall is attached to the rib grid in the internal volume.

In an embodiment of the bladder the bladder wall is generally cylindrical.

In an embodiment, the bladder further comprises: an insert, the insert having: an insert wall; and an internal volume smaller to the internal volume of the bladder wall. This insert may be inserted into the bladder after the shape has been imparted to the bladder, may be attached to the bladder wall, such as, but not limited to, through a fastener mounted external to the insert wall and a complimentary fastener mounted internal to the bladder wall such as hook and look fastener.

In an embodiment of the bladder the bladder wall and insert wall are generally cylindrical.

There is also described herein a method of forming a double walled tank, the method comprising: providing a tank, which may already be underground; providing a bladder comprising: a flexible bladder wall; and a flexible rib grid attached to the bladder wall; collapsing the bladder; inserting the collapsed bladder into the tank; expanding the bladder inside the tank into an expanded shape such as through inflation or vacuum drawing; filling the rib grid with a fill material; and hardening the fill material so that the bladder maintains the expanded shape.

DETAILED DESCRIPTION OF PREFERRED EMBODIMENTS

Embodiments of a self-supporting bladder for use with an underground storage tank are specifically described with respect to FIGS. 1-10. Generally, the self-supporting bladder system is intended for use in conjunction with an existing storage tank. However, one of ordinary skill would see that the system could be used to create an initial tank under the right circumstances. In many embodiments, the existing tank will comprise an underground storage tank such as those commonly used at gas stations and related facilities for the storage of automotive fuel which is modified in situ.

Figure 1:
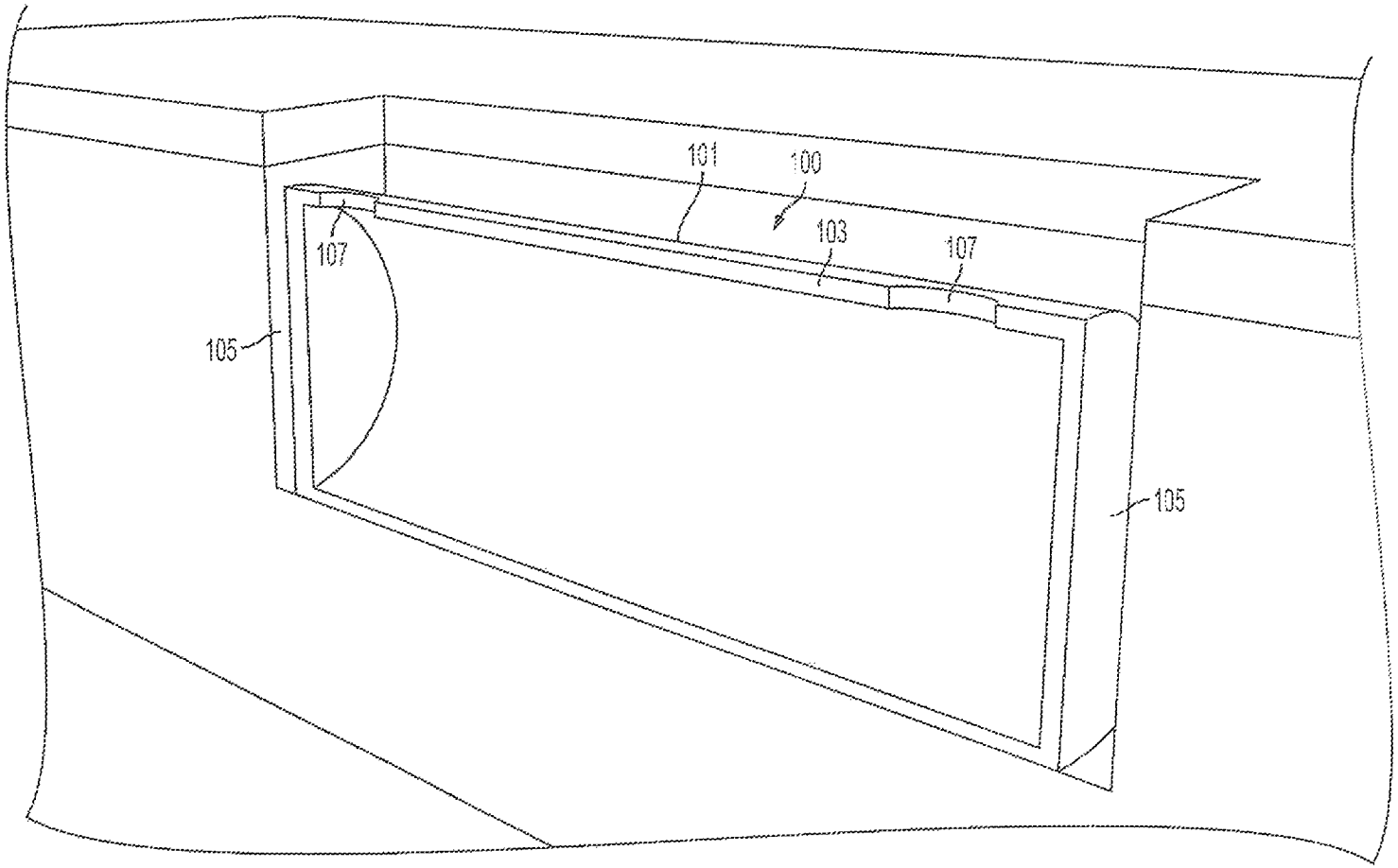
FIG. 1 provides a cut-through drawing of an existing underground tank in situ.
Figure 6:
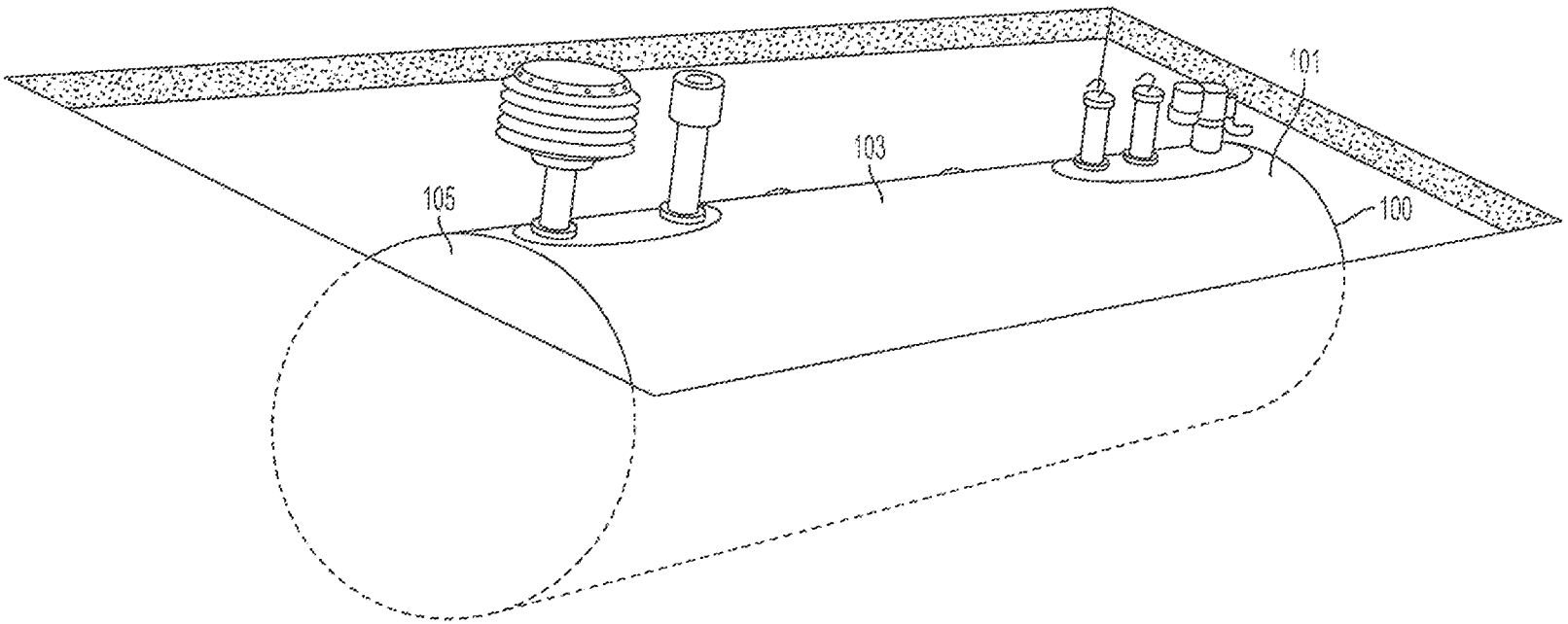
FIG. 6 provides a schematic diagram of an embodiment of an underground tank.

Referring to FIGS. 1 and 6, the existing underground tank (100) will generally be of a single wall design. That is, the tank structure (100) will comprise a single exterior surface or wall (101). The wall (101) will generally be manufactured from steel, fiberglass, or other materials as would be known to those of ordinary skill in the art. A single wall tank is presumed because the bladder system will generally be used to retrofit an already existing tank (100) that is no longer compliant with regulations requiring double wall tanks, or the owner simply wants improved security and safety in his tanks and therefore would be installing a double wall. However, in an alternative embodiment the tank (100) may already include a double, or more, wall and the bladder is being added simply to provide an additional one or more walls to the tank (100) for any reason.

The tank (100) in FIGS. 1 and 6 is generally cylindrical in shape having a smoothly curving rounded side wall (103) and two flat ends (105). The tank (100) will generally include at least one access point (107) which grant access to the tank's (100) internal volume for entry by personnel, to supply material into the internal volume of the tank (100), or to allow machinery for monitoring or related activities to protrude from the tank (100).

Figure 4:
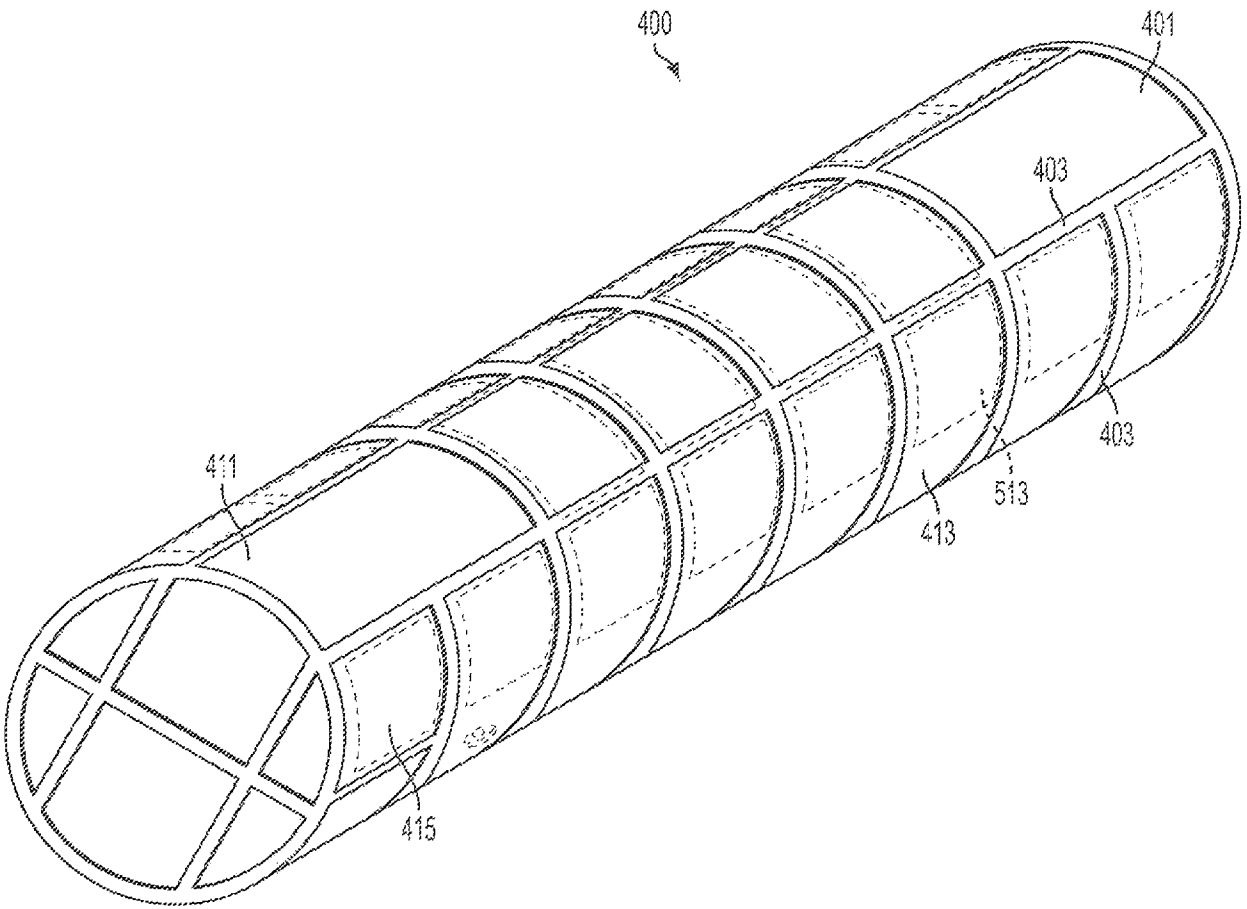
FIG. 4 provides for a drawing of an embodiment of a self-supporting bladder outside of a tank.

As can be seen in FIG. 4, an embodiment of a self-supporting bladder (400) is formed by construction of a generally cylindrical bladder wall (401) encasing a volume. The volume of the bladder (400) will generally be very similar to, but often slightly less than, the volume of the tank (100). The bladder wall (401) will have, generally on the exterior thereof although in an alternative embodiment they may be on the interior, a series of ribs (403). The ribs (403) will generally be provided in a grid-like pattern (referred to as a rib grid (403)) although they may be arranged in any manner as would be understood by one of ordinary skill. In the depicted embodiment, a square grid pattern is used although there are larger spaces (such as space (411) or space (413)) and smaller spaces (such as space (415)) which exist between the ribs (403) and the ribs (403) are not evenly distributed about the exterior surface of the bladder (400).

The bladder (400) may be formed of any material and the material will generally be selected based on the chemical to be stored in the bladder (400) as would be understood by one of ordinary skill in the art. Specifically, the bladder wall (401) will generally be of a material which is relatively resistant to the liquid which is to be placed within the bladder (400). Often, a plastic or similar material will be used. The bladder wall (401) will, however, generally be fairly flexible so as to allow the bladder (400) to be collapsed or compressed (such as by folding or rolling) into a collapsed state where the bladder (400) is reduced in total size so that it can fit through an access opening (107) into the tank (100).

The ribs (403) on the bladder (400) are also generally not rigid, but are constructed as interconnected flexible hollow tubes or similar structures which are separated from the internal volume of the bladder (400) and are solidly attached to the surface of the wall (401). In an embodiment, the ribs (403) are constructed of a similar or same material as the bladder (400) itself. The ribs (403) may utilize the exterior surface of the wall (401) and therefore are essentially channels which are formed in conjunction with the exterior surface of the wall (401), or in an alternative embodiment, the ribs (403) may be self-contained tube structures attached to the wall (403) by any method known to those of ordinary skill in the art including, but not limited to, through the use of adhesives, heat, or chemicals.

As should be apparent, while the embodiment of FIG. 4 provides that the rib grid (403) is placed on the exterior surface of the wall (401), that is not strictly necessary. The rib grid (403) may be placed internal to the bladder wall (401) or may be formed as a part of the wall (401). In the later embodiment, the bladder (400) may be formed of a multilayer material which layers are attached together in a generally permanent fashion, but the rib grid (403) may comprise a pattern wherein the layers are not interconnected, thus, resulting in a "pocket-like" grid structure within the physical structure of the wall (401).

When it is initially constructed, and prior to insertion into a tank (100), the ribs (403) will be flexible and will generally be capable of bending and folding in the same manner that the bladder (400) itself is. The ribs (403) will eventually be used to provide the bladder (400) with its self-supporting structure, however that structure is only added once the bladder (400) is in place in a tank (100). Thus, prior to such event, the ribs (403) generally comprise non-rigid structures.

Figure 7:
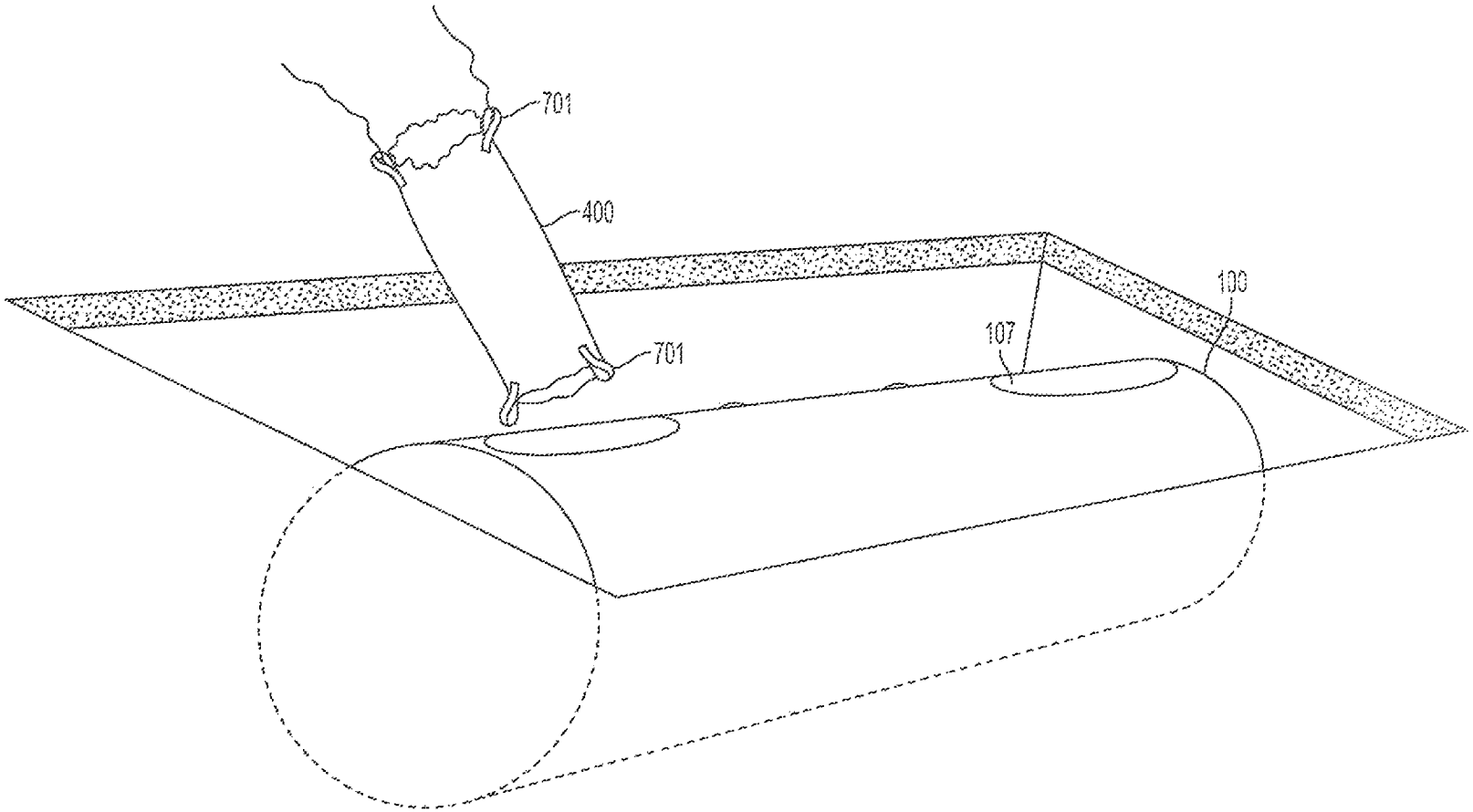
FIG. 7 provides an embodiment of insertion of a self-supporting bladder into the underground tank of FIG. 6 in a collapsed form.

The structure of the bladder (400) is designed to be altered in situ once the bladder (400) has been placed into a tank (100). As shown in FIG. 7, the bladder (400) will initially be inserted into the tank (100) in a collapsed form. In FIG. 7, the bladder (400) has been folded and/or rolled so as to be able to easily fit through an access point (107) in the tank (100) The bladder (400), as is visible in FIG. 7, may include connectors (701) or other structures which are designed to connect the bladder (400) to the tank (100) directly. These may be similar to the connection processes used in existing bladders which are designed to connect near the access points (107).

These connectors (701) may serve to continue to hold the bladder (400) in position relative to the tank (100) even after the ribs (403) have been filled and solidified as discussed below, but are generally most important for providing for initial placement of the collapsed bladder (400) into the tank (100) and therefore may also be designed for temporary connection.

Once the collapsed bladder (400) is within the tank (100), the bladder (400) will be unrolled or otherwise loosely expanded to its generally final shape. As is visible in FIG. 8, the bladder (400) will, thus, be positioned loosely within the volume of the tank (100). The bladder (400) will then generally be inflated, such as by using an air supply (801) which will serve to provide a general low pressure inflation gas into the inner volume of the bladder (400). Upon inflation, the bladder (400) will generally expand to fill the inner volume of the tank (100) and may inflate to its capacity size, the material of the bladder often not being designed to significantly stretch when placed under pressure.

Assuming the volume of the tank (100) and bladder (400) are similar, the bladder (400) will, thus, generally be filling the internal volume of the tank (100) and in close proximity to, or in contact with, the wall (101). In an embodiment, the bladder (400) is not expanded by placing the internal volume under pressure, but the volume inside the tank (100), and external the bladder (400), is placed under vacuum. This may be performed through an existing vacuum pump such as when the bladder (400) is being used in a tank (100) which previously had a bladder that was not self supporting used within it. In a still further embodiment, the bladder (400) may be positioned with a combination of both methods or may simply be positioned in a hanging fashion or other method which does not impart a shape. In this embodiment, the resultant shape may be formed as a result of the filling of the ribs (403).

Figure 8:
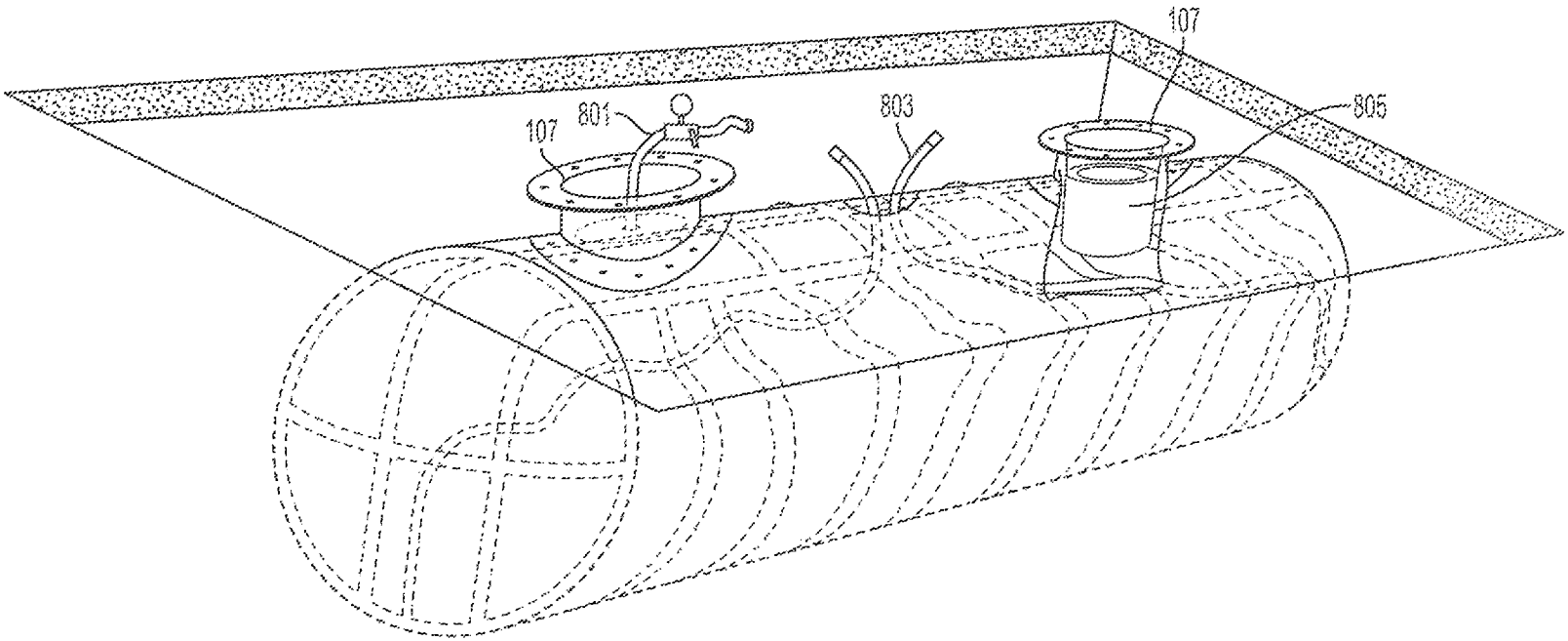
FIG. 8 shows an embodiment of a self-supporting bladder as it is being inflated and the ribs filled with fill material.

As can be seen in FIG. 8, in an embodiment it is desirable for certain additional shapes to be imposed on the inflated bladder (400) structure, or additional components may be added for monitoring. In FIG. 8, there is included a glass insert (805) into the access (107) which is not being used for supplying the internal pressurization. The glass insert (805) can serve to provide for a specific negative opening within the bladder (400) which will correspond with the opening (107) and may also serve to allow personnel to view the inside of the bladder (400) during inflation to verify that it has been correctly positioned and that the epoxy fill operation discussed later is proceeding according to plan.

Once the bladder (400) has been placed into its rough final position and has been pressurized or otherwise expanded so as to generally fill the volume, a fill line will be connected to a port in the rib grid (403). A self-hardening epoxy, thermoset fluid, or other similar material which is capable from transforming from a liquid or semi liquid state to a solid state, and which is generally difficult, if not impossible, to return to the liquid state after such hardening has occurred is generally used as the fill material. However, in an alternative embodiment, the fill can comprise a liquid material that simply acquires rigidity when placed under certain conditions, so long as those conditions can be maintained in the ribs (403).

The fill material will then be pumped into the rib grid (403). Generally, the pumping will occur under pressure so as to insure that the fill material flows throughout the ribs (403) and generally completely fills the ribs (403). Other conditions providing improved flow (such as heat or speed of flow) will also generally be created to assist with the flow. The fill material will preferably be self-hardening or will be capable of hardening due to exposure to a specific catalyst or other effect, such as, but not limited to, heat or ultraviolet light, and will be provided into the rib (403) in a liquid form which will become a solid over time or exposure. Generally, the fill material will be non-expanding, however, in alternative embodiments, the fill material may expand or contract as it hardens so as to provide for slightly different characteristics.

It should be noted that in an alternative embodiment, the fill material need not actually be hardening, but may be provided in a liquid, gel, or other flowable form which will still provide for a sufficiently rigid structure, once positioned to make the rib grid (403) self-supporting. This may be because the fill is provided under pressure and that pressure is maintained after the fill is complete, or may be through another method, such as, but not limited to, use of a thixotropic gel which is flowable when sufficient kinetic energy is imparted, but is otherwise relatively viscous.

Figure 2:
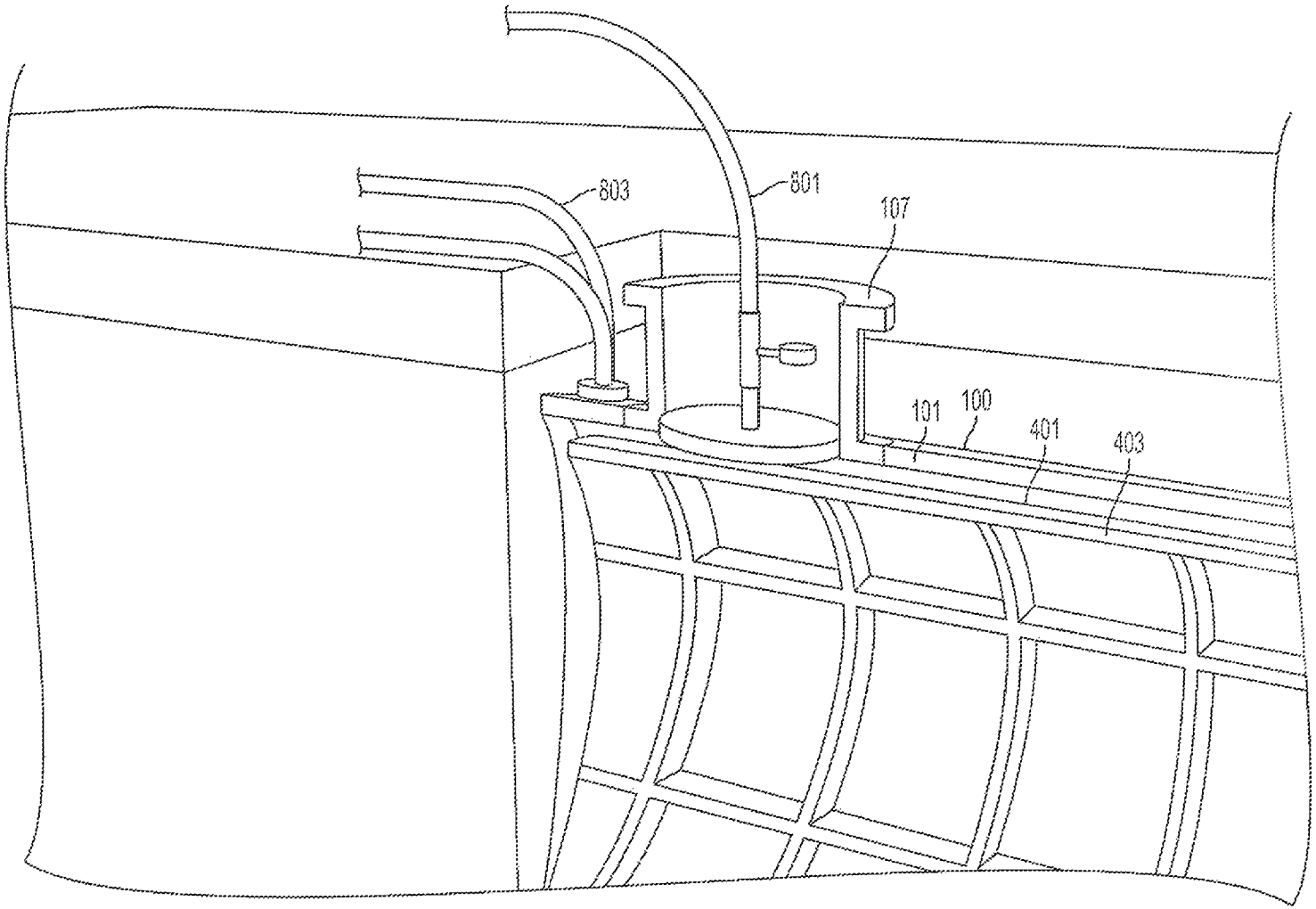
FIG. 2 provides a cut-through drawing of the tank of FIG. 1 having an embodiment of a self-supporting bladder placed therein and showing the resin feed lines and air supply.

Once the fill material has been pumped into the ribs (403), the ribs (403) will generally assume a relatively rigid appearance as is visible in FIG. 2. In effect, at this point in time, the liquid epoxy has been used to pressurize the area inside the rib grid (403) and the rib grid (403) has expanded to form a skeleton surrounding the bladder (400). Even with the fill material being liquid, this skeleton will generally be fairly rigid due to the pressure of the fill material within the ribs (403) and shape of the rib grid (403) serving to form the resultant square grid shape (as was visible in FIG. 4).

Figure 3:
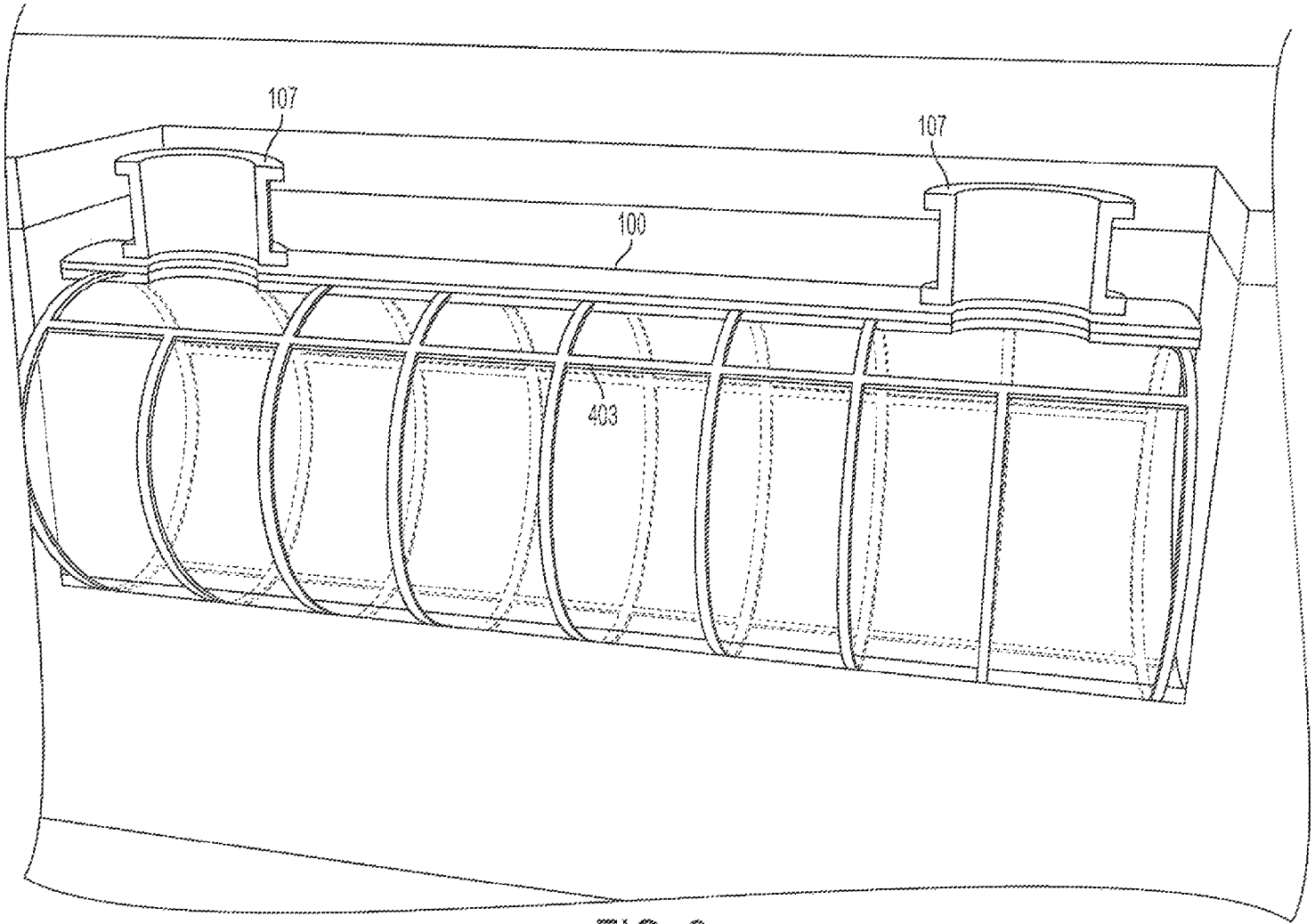
FIG. 3 provides a drawing of an embodiment of a self-supporting bladder in a tank with the tank partially cut away.

While the rib grid (403) in FIGS. 2 and 3 shows the bladder (400) in an essentially "fully-expanded" state where it has assumed the shape of FIG. 4, this is not necessary and in an alternative embodiment, when the ribs are filled they serve to simply extend the bladder (400) to the extent allowed by the internal volume of the tank (100). In this way, the bladder (400) can be designed to conform to the available internal volume of the tank (100) and can be used on a tank (100) whose internal volume is smaller than the volume of the bladder (400) or to conform, or partially conform depending on size and arrangement, the bladder (400) to a shape internal to the tank (100) which may be different from that of the bladder (400)

Once the fill operation has been completed, the fill material in the ribs (403) will be allowed to cure and solidify. After the fill material has been solidified, the air pressure hose (801) may be removed and the pressure released within the internal volume of the bladder (400) and/or on the fill material in the ribs (403). As should be apparent, as the skeleton formed by the ribs (403) is now solid and the ribs (403) are attached to the wall (401) of the bladder (400), the bladder (400) has effectively been given a rigid outer framework (the rib grid (403) skeleton) which will serve to act as a support structure for the bladder (400) making the bladder (400) self-supporting within the tank (100).

As shown in FIG. 3, with the self-supporting bladder (400) in place, the tank (100) has now also become a double walled tank. Specifically, the bladder wall (401) serves as an inner wall with the tank wall (101) as the outer wall. With placement of the ribs (403) external to the bladder (400), there is also a defined interstice between the two walls based on the rib grid (403) positioning the bladder wall (401) a certain distance from the tank wall (101).

This interstice may be used for monitoring of the integrity of the resultant tank (101). Any method of interstice monitoring may be used including, but not limited to, methods like those described in U.S. Pat. No. 7,392,690, the entire disclosure of which is herein incorporated by reference.

While the above contemplates an arrangement where the bladder (400) provides one wall of the double walled tank and the tank (100) provides the other, in an embodiment of the self-supporting bladder (400) it is contemplated that the bladder (400) will be able to provide for a double walled system without reliance on the outer tank (100) at all. That is, the outer wall of the tank (100) effectively does not need to be intact and may lack sufficient integrity to be used to constrain the liquid. Such an embodiment, therefore, can allow a tank which could not be used with prior systems because it lacked sufficient structure, to be repaired or returned to service in a safer fashion.

In an embodiment, the double internal wall may be provided by simply constructing the bladder wall (401) to have a double wall design where the air pressure is inserted into the volume inside the inner wall and the expansion of the rib grid (403) by the fill material injection serves to separate the two walls from each other (the rib grid (403) is between the two walls). In a still another further embodiment, the interstitial space between the two walls may be separately pressurized or vacuum formed as well to provide for a desired interstice. Again, this interstice may include monitoring devices or materials of the type known to those of ordinary skill, or later developed, for use in the detection of leaks in the bladder (400) or outer wall (101).

Figure 5:
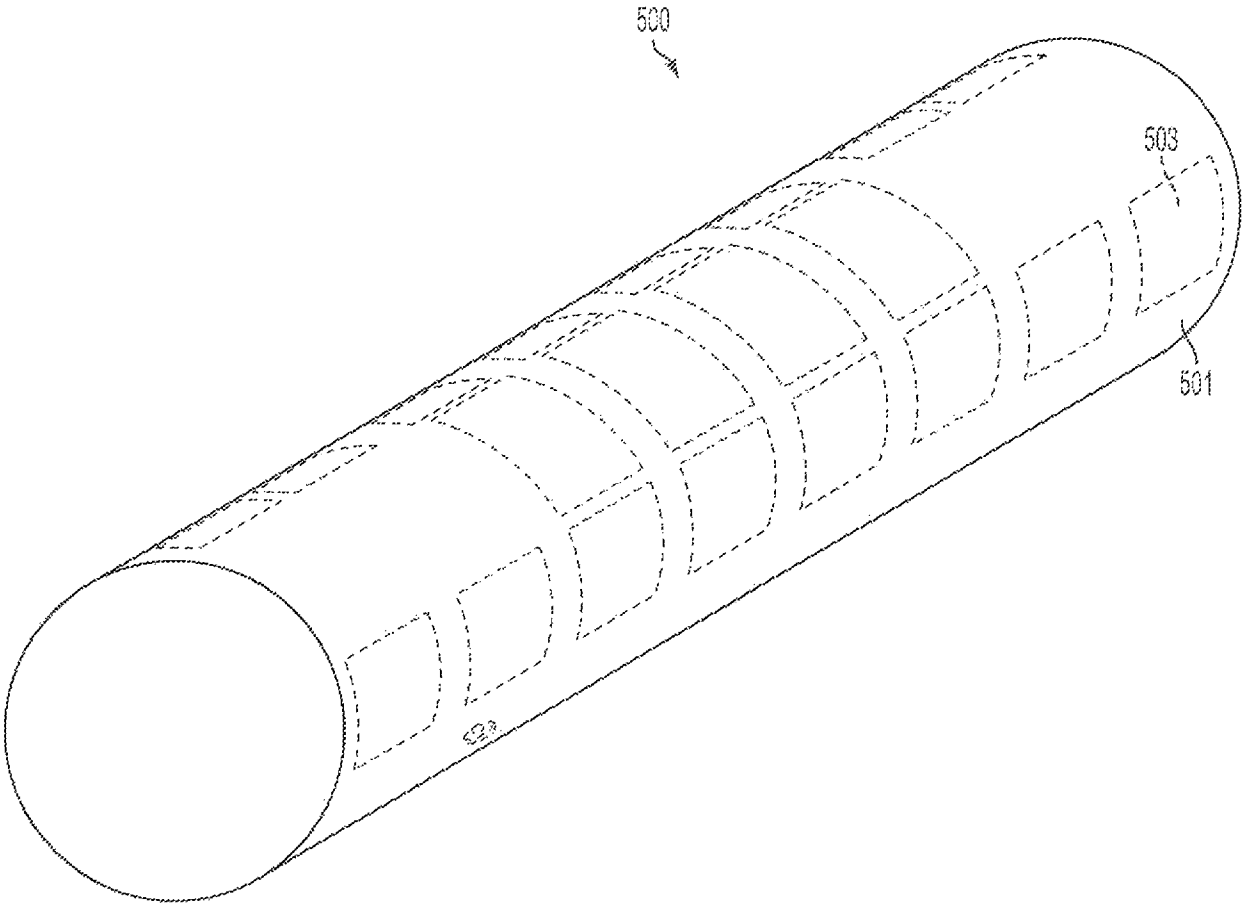
FIG. 5 provides for a drawing of an embodiment of an optional insert for use with the self-supporting bladder of FIG. 4

In a still further embodiment, a double walled bladder (400) may be created after the rib grid (403) skeleton has been created through the hardening of the fill material. In such an embodiment, an internal wall insert (500) as shown in FIG. 5 is placed within the bladder (400) after the bladder (400) has been placed in the tank (100) and the rib grid (403) has hardened to make the bladder (400) self-supporting. That is, once the bladder (400) is in the position of FIG. 3, an insert (500) is installed to create an inner wall within the bladder (400).

FIG. 5 provides for an embodiment of an insert (500) for use as an inner wall in the bladder (400) of FIG. 4. The insert (500) comprises a cylindrical bladder having a wall (501) of generally similar shape to that of bladder (400). The insert (500), however, generally does not include a rib grid (403) (although it may) and is generally of slightly smaller volume than the bladder (400). On the exterior surface of the wall (501) there may be a series of adhesive patches, strips, or other fasteners (503) that comprise a fastening structure or one complimentary half of a fastening structure. As should be apparent, the exact arrangement of the fasteners (503) is variable and they can be provided as strips, portions, or other arrangements, including, but not limited to, covering the entire exterior surface of the wall (501).

Regardless of how the fasteners (503) are arranged, the bladder (400) may include opposing patches (513) (if necessary) which are arranged on the inner surface of wall (401). Patches (513) will include the other component of the fastener (503) to that of the insert (500) in a complimentary fastening system. Alternatively, the fastener (503) may simply be designed to attach to the wall (401) of the bladder (400) directly. In such an embodiment, the opposing patch (513) may not need to include any mating structure, but could simply be a designated point of the bladder wall (401) where the fastener (503) is intended to connect.

In an embodiment, the fastener (503) may comprise an adhesive that only adheres to a mating patch (513). In another embodiment, the two patches (503) and (513) comprise the two halves of a mating fastener material such as hook and loop fastener (sold under the name Velcro™) or may comprise chemicals or other adhesive or fastener agents that adhere together when they come into contact with each other.

While the insert (500) shown in the embodiment of FIG. 5 is designed to utilize mating fasteners to hold it in position, it should be recognized that other means and methods may be used to hold the insert in place. These include conventional means and methods such as the formation of a vacuum between the insert (500) and the bladder (400) in the same fashion that a conventional bladder is held in place in a conventional tank, or may include more elaborate means or methods. In effect, any now known or later developed means or method that are used to position a non self-supporting bladder in an existing tank may be used to position and hold the insert (500) in the bladder (500). These means and methods may be used alone, or in combination with fastener systems such as those discussed above. In another alternative embodiment the insert (500) may also be self-supporting in the same manner as the bladder (400) and may be installed as a separate self-supporting piece internal to the bladder (400).

To install the insert (500) of FIG. 5, the bladder (400) is first installed as discussed above and the fill material in the rib grid (403) is allowed to harden or the methods or means for retaining the shape of the bladder are otherwise imposed. Once the bladder (400) is installed and self-supporting, the insert (500) is inserted into the volume both inside the tank (100) and inside the bladder (400). The insert (500) is, like the bladder (400), inserted in a collapsed form and is opened in situ within the tank (100) generally though the use of air pressure and/or vacuum. Once in place, like the bladder (400), the insert (500) may be pressurized to hold its position through use of an air supply or similar device and a series of connectors such as, but not limited to, as was discussed above in conjunction with placing the bladder (400) in the tank (100).

Assuming the insert (500) has been correctly positioned and sized, as the insert (500) expands, the fasteners (503) will be brought into contact with the patches (513) and the fasteners will enter into a mating or adhering relationship which will serve to attach the two components (the insert (500) and bladder (400)) together. Once the insert (500) has been fully inflated, the air pressure can be removed and the insert (500) will generally be attached (via the fastener (503) interacting with the mating patches (513)) to the inside surface of the bladder (401). As should be apparent, this attachment may be sufficient to maintain the double walled resultant system as a self-supported system or, in alternative embodiments, a secondary device such as a rolling tool may be used to further push the fasteners (503) into a mating relationship. If the insert (500) also includes a rib grid, it may be filled and hardened in the same manner discussed above for the bladder (400).

It should be recognized that with an appropriate design, it is not necessary to completely align the insert (500) into a fixed position with the bladder (400) in order to maintain attachment with the fasteners (503). In particular, the insert (500) may adhere at a variety of different positions all of which are secure so long as the insert (500) is sized, shaped, and originally positioned in an acceptable manner. Similarly, when the insert (500) is expanded to its final position, the fasteners (503) may be at least partially misaligned with the patches (513), but may still interact with them sufficiently to attach.

As liquid placed within the inner volume of the insert may serve to further push the insert (500) into contact with the bladder (400) at all necessary locations, the initial placement may also be considered somewhat temporary and the insert (500) is further positioned once the tank (100) is filled with liquid. In an embodiment, the insert (500) may be essentially hung on the bladder (400) at positions near the access points (107) when the pressurization begins to provide alignment of the insert and bladder about the access points (107). This is similar to the way a traditional non-self-supporting bladder may have been installed. The insert (500) can then be inflated (or exposed to vacuum) so that it generally fills the volume of the bladder (400) in a known fashion.

As should be apparent from the above in an embodiment of the installation it is not necessary for personnel to enter the existing tank at any time. Instead all operations may be performed merely through the access points (107). Still further, as there is no need for the bladder (400) to adhere to the surface of the tank (100), there may not be a need to clean the tank (100) prior to installation.

As discussed earlier, the interstice formed between the insert (500) and bladder (400) may again include monitoring devices or materials for use in detecting leaks in the insert (500) or bladder (400). This can include, but is not limited to, simply maintaining a vacuum which was originally used to position the insert (500).

Figure 9:
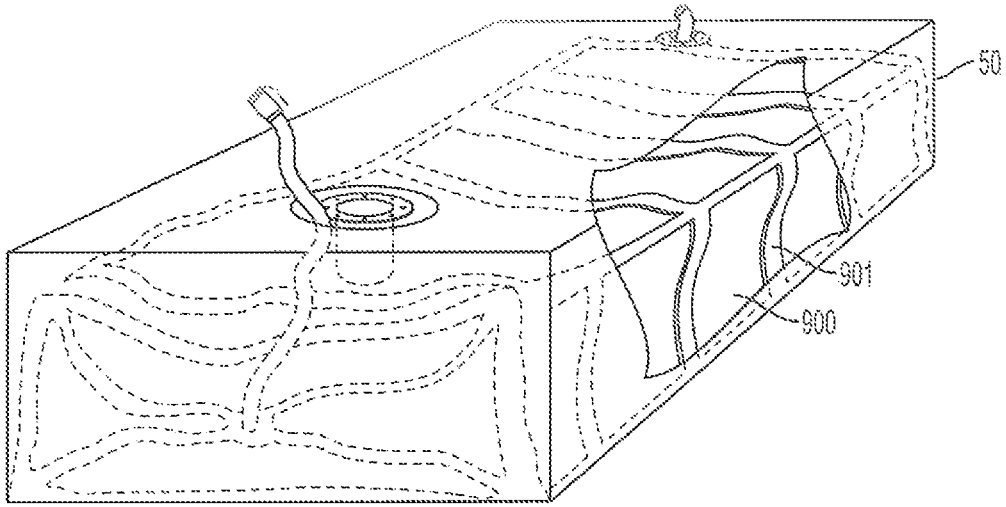
FIG. 9 shows another embodiment of a self-supporting bladder in place in a tank and prior to fill material injection.
Figure 10:
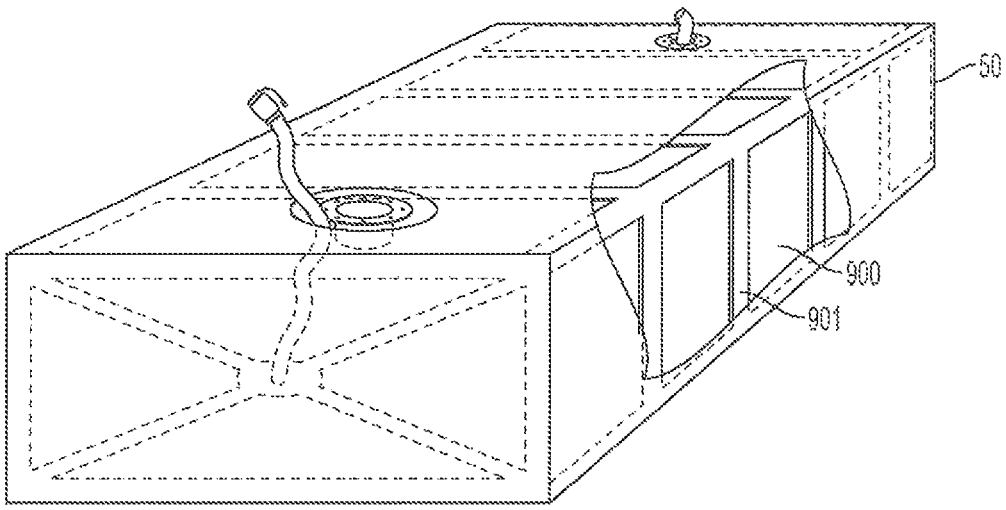
FIG. 10 shows the embodiment of FIG. 9 after fill material injection and hardening.

While FIGS. 1-8 provide for an embodiment of a bladder (400) geared particularly for use in cylindrical underground tanks, and specifically motor fuel storage tanks which are generally of such shape, the bladder (400) may be used in other forms of tank and structure. FIGS. 9 and 10 provide for another embodiment of a bladder (900) which is designed to be used in a rectangular storage tank (50). This is often a tank more commonly used above ground as it is not subject to the mass of earth pressing on it. Bladder (900) is generally of similar design to bladder (400) and is installed in a generally similar fashion. As can be seen, however, in FIGS. 9 and 10, the bladder (900) may include a different rib grid pattern (901) which is more specifically designed for a different shape of bladder (900). Such grid patterns (901) may include specific points to allow for the shape to correctly expand as the rib grid (901) is filled with fill material as designs having corners or similar shapes may require specific fills to make sure that they expand correctly. The bladder (900) may also be provided with a mating insert as contemplated above.

While the FIGS provide for different embodiments of bladders (400) and (900), it should be recognized that these are clearly not the only shapes that may be formed. In alternative embodiments, the bladder (400) or (900) may be formed into virtually any shape which would be useful to convert any existing tank (50) or (100) to a double wall tank. Further, while the bladder (400) and (900) are also generally sized to be of similar shape and size to the tank (100) or (50) into which they are inserted, this is also not necessary. As the bladder (400) and (900) is self supporting, the bladder (400) and (900) may be of any size and shape which at least partially encapsulates the internal volume of the tank (50) or (100) into which it is installed. Further, any shape of bladder may be used with any shape of insert to provide a resultant structure having desired storage qualities and design.

Still further, while the bladders (400) and (900) are particularly useful for tanks (50) and (100) for the storage of petroleum products such as motor fuel or heating oil, it should be noted that they can be useful for the storage of other materials. One example is that a bladder (400) or (900) can be used to convert an existing tank for storage of petroleum-based material to store a plant based fuel (e.g. ethanol or bio-diesel) which may be undesirably corrosive when used with the existing tank structure. Such an embodiment will generally utilize an insert (500) as the outer tank (100), while likely still capable of holding the liquid, would be expected to corrode in an undesirable manner if it was placed in direct contact with the liquid. This would, effectively, be a triple walled tank, with the outermost tank simply being considered of insufficient design to be a safety barrier, although it may act as one for at least some period of time.

Similarly, other tanks can be outfitted with bladders to store other materials including food products (such as, but not limited to water, milk, beer, wine, or juices), industrial chemicals (such as, but not limited to, acids), raw materials for future processing or disposal (such as, but not limited to, raw sewage, rendering outputs, or paper mill waste), or other materials as would be known to those of ordinary skill. Further, because the liquid will generally not contact the original tank surfaces, tanks which held hazardous chemicals may actually be able to be retrofitted to hold different chemicals (such as foods) because there is no contact between the liquid and the tank, even if the tank has not (or cannot) be sufficiently cleaned. Similarly, it is not required that the bladders (400) and (900) only be used in static storage tanks for liquids but the bladders (400) and (900) may be designed for use in flowing systems, such as, but not limited to pipelines, or for systems for the storage of other material states such as, but not limited to, gels, suspensions, flowable solids, granular materials, or gases that may have similar storage issues to the liquids discussed herein.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A self supporting bladder configured for use in retrofitting a tank, the bladder comprising:

a bladder wall having an internal volume; and a rib grid attached to said bladder wall;

wherein, said bladder wall and said rib grid are both configured to be flexible for when said bladder and said rib grid, in combination, are is inserted into said tank; and wherein, once within a tank, said rib grid is filled with a fill material wherein said filling imparts a new shape on said bladder wall and makes said bladder self supporting; and an insert, said insert having an insert wall and an internal volume smaller than said internal volume of said bladder wall; and wherein said insert wall is attached to said bladder wall through a fastener mounted external to said insert wall and a complimentary fastener mounted internal to said bladder wall.

2. The bladder of claim 1 wherein said fill material is placed in said rib grid in liquid form and hardens to impart said shape on said bladder.

3. The bladder of claim 2 wherein said fill material is self hardening.

4. The bladder of claim 3 wherein said fill material is an epoxy resin.

5. The bladder of claim 2 wherein said fill material hardens when exposed to a catalyst.

6. The bladder of claim 1 wherein said fill material comprises a thixotropic gel.

7. The bladder of claim 1 wherein said fill material is maintained under pressure once placed in said rib grid.

8. The bladder of claim 1 wherein said rib grid is attached to an external surface of said bladder wall.

9. The bladder of claim 1 wherein said rib grid is attached to an internal surface of said bladder wall.

10. The bladder of claim 9 wherein an inner wall is attached to said rib grid in said internal volume.

11. The bladder of claim 1 wherein said bladder wall is generally cylindrical.

12. The bladder of claim 1 wherein said insert is inserted into said bladder after said shape has been imparted to said bladder.

13. The bladder of claim 12 wherein said fastener and complimentary fastener comprise the two portions of hook and loop fastener.

14. The bladder of claim 1 wherein said bladder wall is generally cylindrical.

15. The bladder of claim 14 wherein said insert wall is generally cylindrical.

* * * * *